US008172370B2

(12) United States Patent
Reitmeier

(10) Patent No.: US 8,172,370 B2
(45) Date of Patent: May 8, 2012

(54) PLANAR HEATER STACK AND METHOD FOR MAKING PLANAR HEATER STACK

(75) Inventor: Zachary Justin Reitmeier, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 698 days.

(21) Appl. No.: 12/345,972

(22) Filed: Dec. 30, 2008

(65) Prior Publication Data

US 2010/0165055 A1 Jul. 1, 2010

(51) Int. Cl.
*B41J 2/05* (2006.01)

(52) U.S. Cl. ..... 347/63; 347/64; 347/65

(58) Field of Classification Search ..... 347/63, 347/64, 65, 201–204
See application file for complete search history.

(56) References Cited

U.S. PATENT DOCUMENTS

| | | | | |
|---|---|---|---|---|
| 4,532,530 | A * | 7/1985 | Hawkins | 347/62 |
| 4,935,752 | A * | 6/1990 | Hawkins | 347/62 |
| 5,257,042 | A * | 10/1993 | Buhler | 347/64 |
| 5,719,604 | A * | 2/1998 | Inui et al. | 347/54 |
| 6,340,223 | B1 * | 1/2002 | Hirata | 347/56 |
| 6,594,899 | B2 * | 7/2003 | Maze et al. | 29/890.1 |
| 7,195,343 | B2 | 3/2007 | Anderson et al. | |
| 7,872,212 | B2 * | 1/2011 | Sims | 219/209 |
| 2009/0315951 | A1 * | 12/2009 | Lebens et al. | 347/63 |

FOREIGN PATENT DOCUMENTS

| | | | |
|---|---|---|---|
| JP | 01110156 | A * | 4/1989 |
| JP | 01110157 | A * | 4/1989 |

* cited by examiner

*Primary Examiner* — Matthew Luu
*Assistant Examiner* — Henok Legesse

(57) ABSTRACT

A heater stack includes first strata configured to form a fluid heater element responsive to energy from repetitive electrical activation and deactivation to fire repetitive cycles of heating and ejecting fluid from an ejection chamber above the fluid heater element and second strata overlying the first strata and contiguous with the ejection chamber to provide protection of the fluid heater element. The first strata includes a substrate and a heater substrata overlying the substrate and including a resistive layer having lateral portions spaced apart, a central portion extending between the lateral portions and defining the fluid heater element, and transitional portions interconnecting the central portion and lateral portions and elevating the central portion relative to the lateral portions and above the substrate to form a gap between the lateral portions and between the central portion and substrate insulating the substrate from the fluid heater element and a planar upper surface on the heater substrata.

6 Claims, 4 Drawing Sheets

PLANAR HEATER STACK AND METHOD FOR MAKING PLANAR HEATER STACK

BACKGROUND

1. Field of the Invention

The present invention relates generally to micro-fluid ejection devices and, more particularly, to a planar heater stack and methods for making the planar heater stack.

2. Description of the Related Art

Micro-fluid ejection devices have had many uses for a number of years. A common use is in a thermal inkjet printhead in the form of a heater chip. In addition to the heater chip, the inkjet printhead basically includes a source of supply of ink, a nozzle plate attached to or integrated with the heater chip, and an input/output connector, such as a tape automated bond (TAB) circuit, for electrically connecting the heater chip to a printer during use. The heater chip is made up of a plurality of resistive heater elements, each being part of a heater stack. The term "heater stack" generally refers to the structure associated with a portion of the thickness of the heater chip that includes first, or heater forming, strata made up of resistive and conductive materials in the form of layers or films on a substrate of silicon or the like and second, or protective, strata made up of passivation and cavitation materials in the form of layers or films on the first strata, all fabricated by well-known processes of deposition, patterning and etching upon the substrate of silicon. The heater stack also has one or more fluid vias or slots that are cut or etched through the thickness of the silicon substrate and the first and second strata, using these well-known processes, and serve to fluidly connect the supply of ink to the heater stacks. A heater stack having this general construction is disclosed as prior art in U.S. Pat. No. 7,195,343, which patent is assigned to the same assignee as the present invention. The entire disclosure of this patent is hereby incorporated herein by reference.

Despite their seeming simplicity, construction of heater stacks requires consideration of many interrelated factors for proper functioning. The current trend for inkjet printing technology (and micro-fluid ejection devices generally) is toward lower jetting energy, greater ejection frequency, and in the case of printing, higher print speeds. A minimum quantity of thermal energy must be present on an external surface of the heater stack, above a resistive heater element therein, in order to vaporize the ink inside an ink chamber between the heater stack external surface and a nozzle in the nozzle plate so that the ink will vaporize and escape or jet through the nozzle in a well-known manner.

During inkjet heater chip operation, some of the heating energy is wasted due to heating up the "heater overcoat", or the second strata, and also heating up the substrate. Since heating or jetting energy required is proportional to the volume of material of the heater stack that is heated during an ejection sequence, reducing the heater overcoat thickness, as proposed in U.S. Pat. No. 7,195,343 is one approach to reducing the jetting energy required. However, as the overcoat thickness is reduced, corrosion of the ejectors or heater elements becomes more of a factor with regard to ejection performance and quality. So this patent proposes the additional steps of applying a sacrificial layer of an oxidizable metal on the resistive heater layer and then oxidizing the sacrificial layer to convert it to exhibit a protective function rather than a conductive function and thereby obviate the potential corrosive impacts of reducing overcoat thickness.

However, with the overcoat thickness decreasing, heat loss to the substrate then becomes the dominant factor. Thus, there is a need for an innovation that will reduce the heat loss to the substrate.

SUMMARY OF THE INVENTION

In an aspect of the present invention, a heater stack for a micro-fluid ejection device includes first strata configured to support and form a fluid heater element responsive to energy from repetitive electrical activation and deactivation to fire repetitive cycles of heating and ejecting of a fluid from an ejection chamber above the fluid heater element. The first strata include a substrate and heater substrata overlying the substrate.

The heater substrata includes a resistive layer having lateral portions spaced apart from each other, a central portion extending generally between the lateral portions and defining the fluid heater element of the first strata, and transitional portions respectively interconnecting the central portion and lateral portions and extending upwardly and toward one another from the lateral portions so as to elevate the central portion relative to the lateral portions and spaced above the substrate to form a gap extending between the lateral portions and between the central portion and the substrate substantially insulating the substrate from the fluid heater element so as to reduce heat transfer from the fluid heater element to the substrate and thereby increase heat transfer into the fluid in the ejection chamber from firing the repetitive cycles of heating and ejecting of the fluid from the ejection chamber above the fluid heater element.

The heater substrata also includes a conductive layer having anode and cathode portions separated from one another by the central portion of the resistive layer and by the gap underlying the fluid heater element of the central portion of the resistive layer, the anode and cathode portions respectively overlying the lateral and transitional portions of the resistive layer and extending to a height above the lateral portions of the resistive layer approximately level with a height of the central portion of the resistive level above the substrate so as to provide the heater substrata with a substantially planar upper surface formed by the anode and cathode portions of the conductive layer and the central portion of the resistive layer.

The heater stack also includes second strata disposed on the anode and cathode portions of the conductive layer and the central portion of the resistive layer of the first strata in a substantially level orientation so as to overlie the first strata and be contiguous with an ejection chamber above the second strata and provide protection of the fluid heater element from adverse effects of the repetitive cycles of fluid ejection and of the fluid in the ejection chamber.

In another aspect of the present invention, a method for making a heater stack includes depositing and patterning a sacrificial material on a substrate to provide a layer of the sacrificial material having tapered peripheral edge portions and of a predetermined size and thickness corresponding to a desired gap in the heater stack, processing one sequence of materials to produce first strata having a heater substrata overlying the substrate and the layer of sacrificial material such that a fluid heater element in the heater substrata overlies the layer of sacrificial material and its tapered peripheral edge portions and such that the heater substrata have a substantially planar upper surface, and removing the layer of sacrificial material to leave the gap above the substrate, substantially emptied of sacrificial material, and below the fluid heater element for insulating the substrate from transfer of heat energy produced by the fluid heater element to fire repetitive cycles of ejection of the fluid from an ejection chamber above the fluid heater element.

The processing one sequence of materials includes depositing and patterning a resistive layer over the substrate and layer of sacrificial material and the tapered peripheral edge portions thereof to provide lateral portions of the resistive layer on the substrate spaced apart from each other, a central portion of the resistive layer on the layer of sacrificial material extending generally between the lateral portions, and transitional portions on the tapered peripheral edge portions respectively interconnecting the central portion and lateral portions and extending upwardly and toward one another from the lateral portions to the central portion elevated by the layer of sacrificial material and the tapered peripheral edge portions thereof relative to the lateral portions and substrate.

The processing one sequence of materials also includes depositing and patterning a conductive layer over the resistive layer to provide separate anode and cathode portions respectively overlying and deposited on the lateral and transitional portions of the resistive layer and extending to a height above the lateral portions of the resistive layer approximately level with the height of the central portion of the resistive layer above the substrate such that the anode and cathode portions are interconnected and separated by the central portion of the resistive layer to define the fluid heater element therewith overlying the layer of sacrificial material and provide the heater substrata with a substantially planar upper surface formed by the anode and cathode portions of the conductive layer and the central portion of the resistive layer.

The method further includes processing another sequence of materials to produce second strata overlying the first strata and contiguous with the ejection chamber above the second strata to provide protection of the fluid heater element from adverse effects of the repetitive cycles of fluid ejection and of the fluid in the ejection chamber.

BRIEF DESCRIPTION OF THE DRAWINGS

Figure 1:
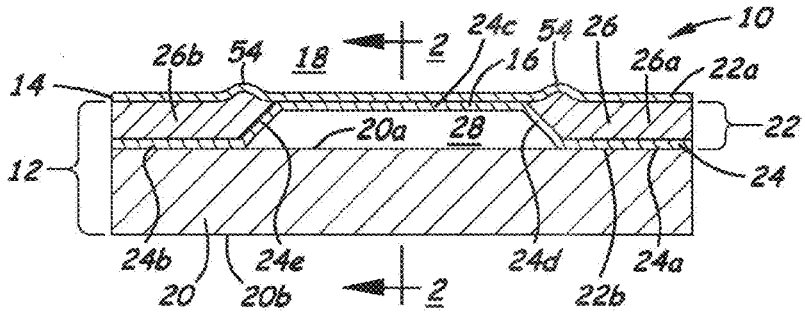

Having thus described the invention in general terms, reference will now be made to the accompanying drawings, which are not necessarily drawn to scale and in some instances portions may be exaggerated in order to emphasize features of the invention, and wherein:

FIG. 1 is a cross-sectional schematic representation, not to scale, of an exemplary embodiment of a heater stack of a micro-fluid ejection device in accordance with the present invention.

Figure 2:
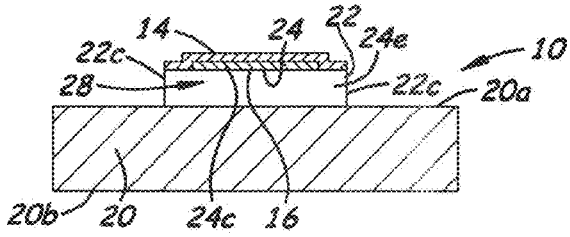

FIG. 2 is a sectional view of the heater stack of FIG. 1 taken along line 2-2 of FIG. 1.

Figure 3:
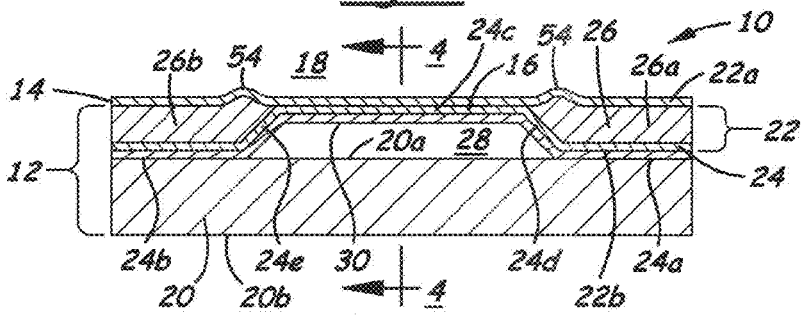

FIG. 3 is a cross-sectional schematic representation, not to scale, of another exemplary embodiment of the heater stack similar to that of FIG. 1 but now having a protective layer on an underside of heater substrata of the heater stack.

Figure 4:
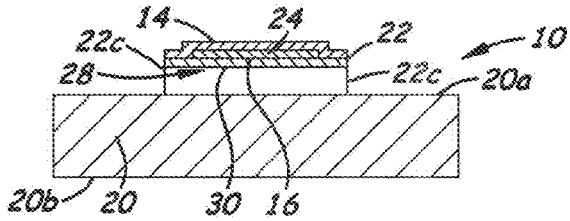

FIG. 4 is a sectional view of the heater stack taken along line 4-4 of FIG. 3.

Figure 5:
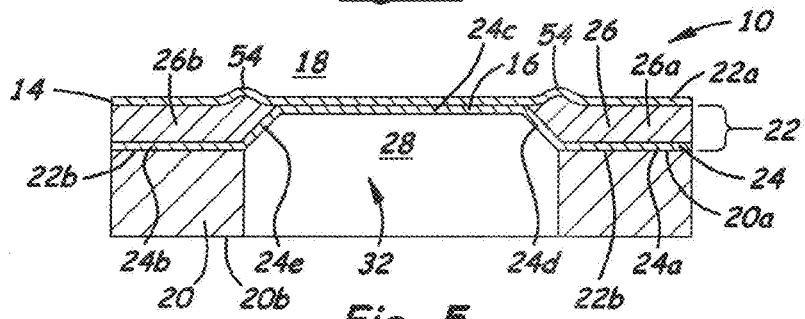

FIG. 5 is a cross-sectional schematic representation, not to scale, of still another exemplary embodiment of the heater stack similar to that of FIG. 1 but now having an ink via or supply channel underneath the heater element of the heater stack.

Figure 6A:
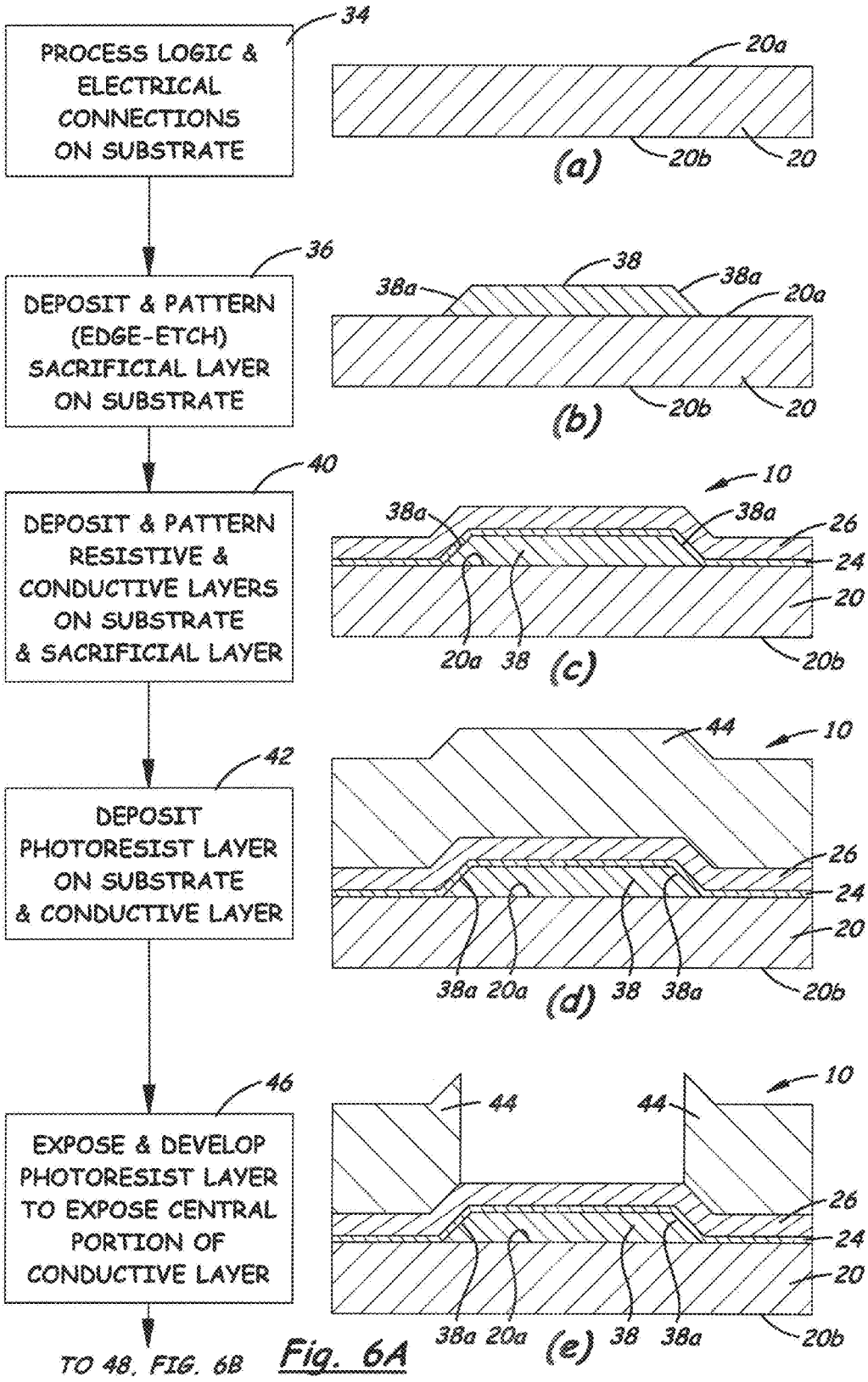
Figure 6B:
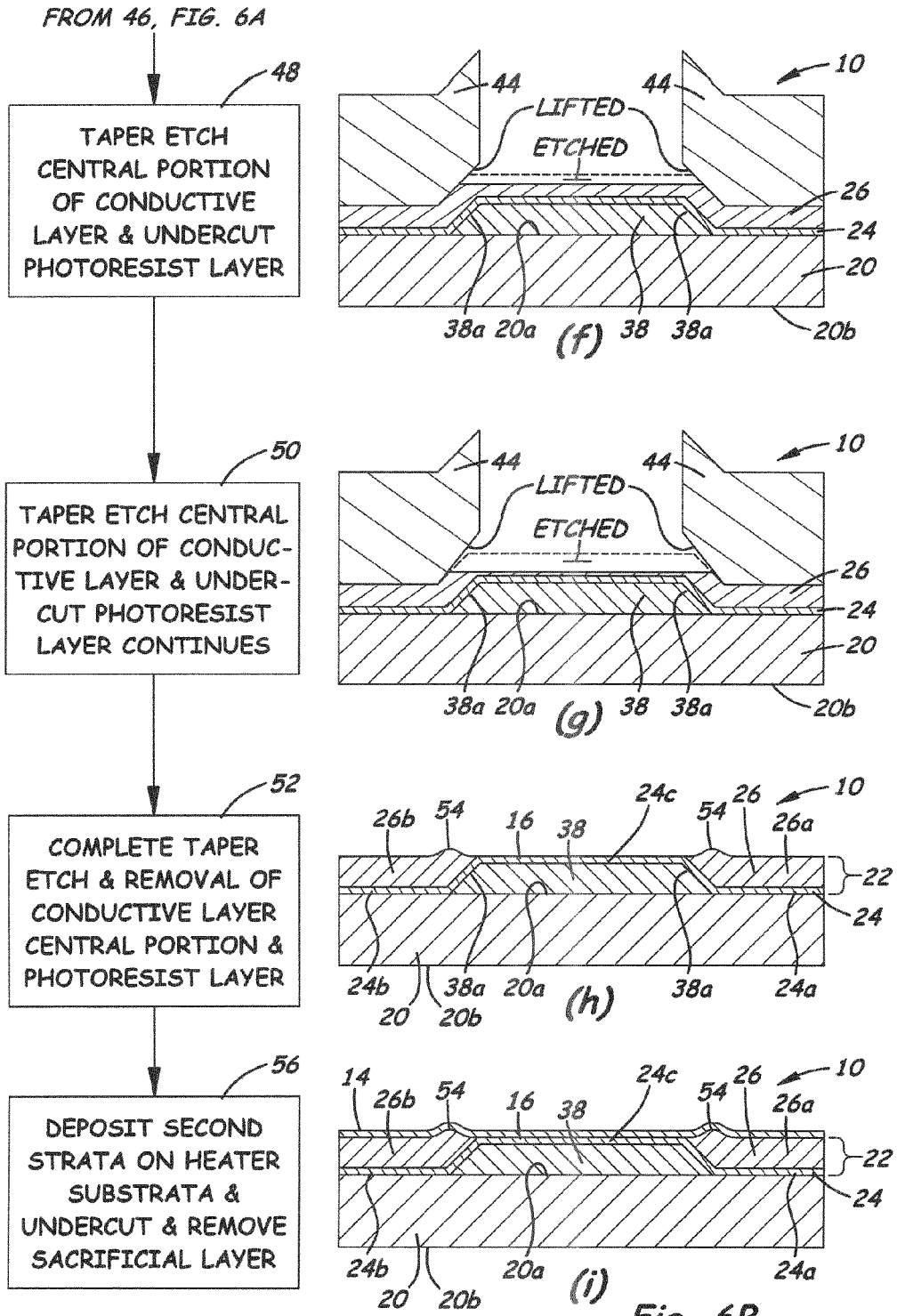
Figure 7:
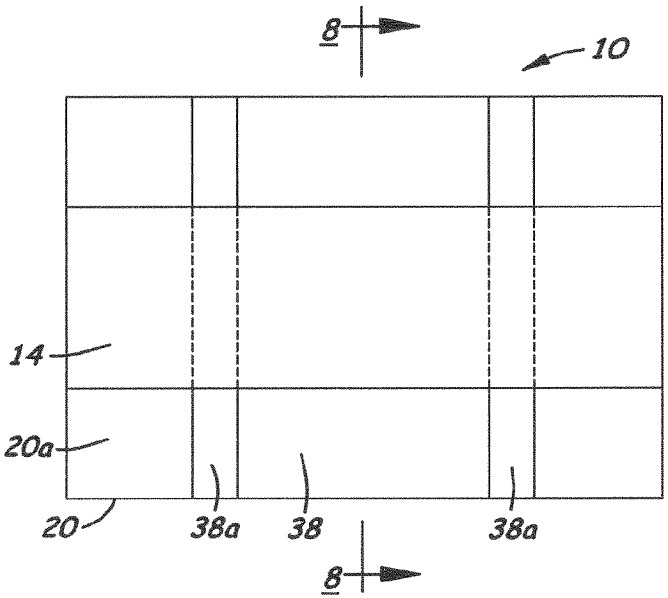

FIGS. 6A and 6B together are a flow diagram with accompanying schematic representations (a) to (i), not to scale, of an exemplary sequence of stages in a method for making the heater stack of FIGS. 1 and 2 in accordance with the present invention FIG. 7 is a top plan view of the heater stack at the stage of schematic representation (i) of FIG. 6B.

Figure 8:
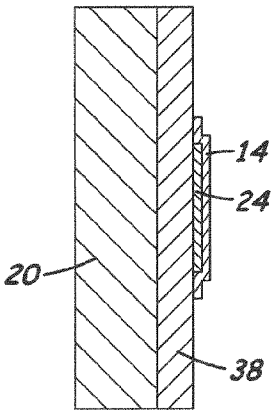

FIG. 8 is a sectional view of the heater stack taken along line 8-8 of FIG. 7.

Figure 9:
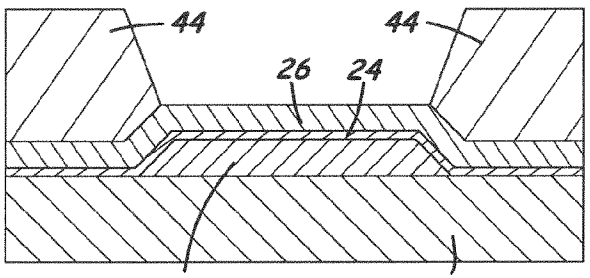

FIG. 9 is a cross-sectional schematic representation, not to scale, of an alternative step of the method using grayscale lithography to pattern and mask the conductive layer of first strata of the heater stack.

Figure 10:
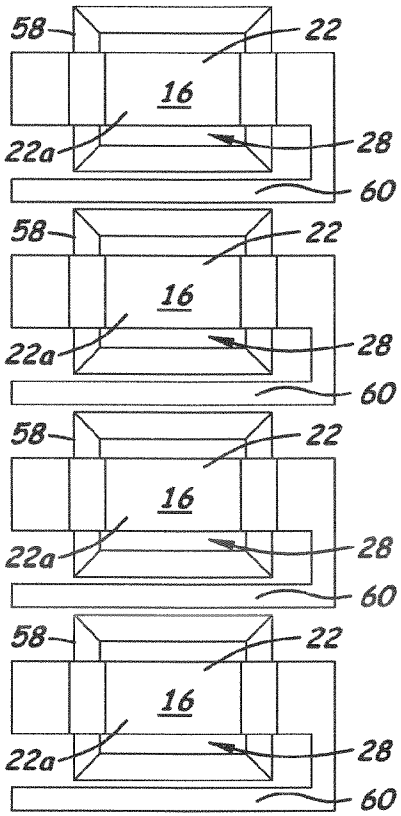

FIG. 10 is a top plan view of an array of the heater stacks of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Also, the present invention applies to any micro-fluid ejection device, not just to heater stacks for thermal inkjet printheads. While the embodiments of the present invention will be described in terms of a thermal inkjet printhead, one of ordinary skill will recognize that the invention can be applied to any micro-fluid ejection system.

Referring now to FIGS. 1 and 2, there is illustrated an exemplary embodiment of a heater stack, generally designated 10, of a micro-fluid ejection device in accordance with the present invention. The heater stack 10 basically includes first (or heater forming) strata, generally designated 12, and second (or protective) strata, generally designated 14. The first strata 12 are configured to support and form a fluid heater element 16 in the heater stack 10 that is responsive to repetitive electrical activation and deactivation to produce repetitive cycles of fluid ejection from the ejection device. The second strata 14 overlie the first strata 12, are contiguous with a fluid ejection chamber 18 above the second strata 14, and are configured to protect the heater element 16 from well-known adverse effects of the repetitive cycles of fluid ejection from the ejection chamber 18.

More particularly, the first strata 12 of the heater stack 10 include a substrate 20 and heater substrata, generally designated 22, overlying a front surface 20*a* of the substrate 20. The heater substrata 22 include an electrical resistive film or layer 24 and an electrical conductor film or layer 26. The resistive layer 24 has right and left lateral portions 24*a*, 24*b* spaced apart from each other, a central portion 24*c* extending generally between the lateral portions 24*a*, 24*b* and defining the fluid heater element 16 in the heater substrata 22, and right and left transitional portions 24*d*, 24*e* interconnecting the central portion 24*c* with the right and left lateral portions 24*a*, 24*b*. The transitional portions 24*d*, 24*e* extend upwardly and inwardly toward one another from the lateral portions 24*a*, 24*b* so as to elevate the central portion 24*c* relative to the lateral portions 24*a*, 24*b* and space the central portion 24*c* above the substrate 20 to form a gap 28 between the central portion 24*c* and the front surface 20*a* of the substrate 20. The gap 28 insulates the substrate 20 from the fluid heater element 16 in the heater substrata 22 so as to reduce heat transfer from the fluid heater element 16 to the substrate 20 and thereby enable an increased heat transfer from the fluid heater element 16 into the fluid, such as ink, in the ejection chamber 18 from each firing of the repetitive cycles of heating and ejecting of the fluid from the fluid ejection chamber 18 above the fluid heater element 16.

The substrate 20 is typically made from a wafer of silicon or the like. The electrically conductive layer 26 of the heater substrata 22 partially overlies the resistive layer 24. The conductor layer 26 has an anode portion 26*a* and a cathode portion 26*b* on the resistive layer 24 separated from one another by the central portion 24*c* of the resistive layer 24 and by the gap 28 underlying the fluid heater element 16 of the central portion 24*c* of the resistive layer 24. The anode and cathode portions 26*a*, 26*b* respectively overlie and are deposited on the right and left lateral portions 24*a*, 24*b* and the right and left transitional portions 24*d*, 24*e* of the resistive layer 24 and extend to a height above the lateral portions 24*a*, 24*b* approximately level with the height of the central portion 24*c* of the resistive layer 24 above the substrate 20 so as to provide the heater substrata 22 with a substantially planar upper surface 22*a* formed by the anode and cathode portions 26*a*, 26*b* of the conductive layer 26 interconnected with the central portion 24*c* of the resistive layer 24. The anode and cathode portions 26*a*, 26*b* of the conductor layer 26, being positive and negative terminals of ground and power leads, cooperate with the central portion 24*c* of the resistive layer 24 to form the fluid heater element 16 of the heater substrata 22 of the first strata 12. By way of example and not of limitation, the various layers of the first strata 12 can be made of the various materials and have the ranges of thicknesses as set forth in above cited U.S. Pat. No. 7,195,343.

The second strata 14 of the heater stack 10 overlie the first strata 12 and more particularly the heater substrata 22 of the first strata 12 to protect the resistive fluid heater element 16 from the well-known adverse effects of fluid forces generated by the repetitive cycles of fluid ejection from the ejection chamber 18 above the second strata 14. Although only shown as a single layer in FIG. 1, the second strata 14 typically include at least two layers, a passivation (protective) layer and a cavitation (protective) layer. The function of the passivation layer is primarily to protect the resistive and conductor layers 24, 26 of the first strata 12 from fluid corrosion and provide electrical isolation. The function of the cavitation layer is to provide protection to the fluid heater element 16 during fluid ejection operation which would cause mechanical damage to the heater stack 10 in the absence of the cavitation layer. Any suitable material or combination of material sets that offer electrical isolation and mechanical protection of the heater substrata 22 may be used. Examples are a bi-layer stack such as made of silicon nitride and tantalum, or an ultra-thin overcoat of a protective metal oxide such as $Ta_2O_5$, $HfO_2$, $Al_2O_3$, etc. Also, by way of example and not of limitation, the various layers of the second strata 14 also can be made of the various materials and have the ranges of thicknesses as set forth in above cited U.S. Pat. No. 7,195,343.

FIGS. 3 and 4 illustrate another exemplary embodiment of the heater stack 10 basically similar to the one exemplary embodiment shown in FIGS. 1 and 2, but now also having a protective layer 30 deposited on an underside 22*b* of the heater substrata 22 of the heater stack 10. FIG. 5 illustrates still another exemplary embodiment of the heater stack 10 basically similar to the one exemplary embodiment shown in FIGS. 1 and 2, but now having an ink via or supply channel 32 formed underneath the heater element 16 of the heater stack 10. With respect to the heater stack 10 in FIGS. 1-4, the ink supply would be from the lateral direction. With respect to the heater stack 10 in FIG. 5, the ink supply is shown underneath the heater element 16. In this case, individual ink vias or supply channels 32 are formed for each heater stack 10. The advantages of this embodiment are that the chip size can be reduced due to the removal of the large ink via supplying all heater stacks and the bubble that forms on the backside of the suspended heater element can be used not only to displace fluid for drop ejection but also to shut off the ink supply from the backside of the heater stack 10 during firing.

Referring now to FIGS. 6A and 6B, there are illustrated a block flow diagram with accompanying schematic representations, not to scale, of a sequence of stages carried out in the making, or building the layers of, the exemplary embodiment of the heater stack 10 of FIGS. 1 and 2 in accordance with the method of the present invention. Turning first to FIG. 6A, as per first block 34 and schematic representation (a) the substrate 20 in the first strata 12 is a base wafer or layer of silicon. All necessary logic and electrical connections have been processed and formed on the substrate 20, providing a conventional partially-completed CMOS-based inkjet wafer. All the other layers of the first and second strata 12, 14 will be deposited and patterned on the substrate 20 by using selected ones of conventional thin film integrated circuit processing techniques including layer growth, chemical vapor deposition, photo resist deposition, masking, developing, etching and the like.

Next, as per second block 36 and schematic representation (b), a layer 38 of sacrificial material is deposited and patterned on the front surface 20*a* of the substrate 20 by use of a taper etch process whereby the layer 38 will have tapered peripheral edge portions 38*a* and be of a predetermined size (length and width), shape and thickness corresponding to the desired size of the gap 28 to be provided in the heater substrata 22 of the heater stack 10 and also that effectively enables the planarizing the upper surface 22*a* of the heater substrata 22. The sacrificial layer 38 is deposited by being spun or coated upon the front surface 20*a* of the substrate 20. Then, a photoresist mask (not shown) is formed using conventional steps of photolithography and portions not covered by the photoresist mask are taper-etched away leaving the sacrificial layer 38 of the desired shape and dimensions coated on the substrate 20. The material forming the sacrificial layer 38 preferably is silicon oxide. The taper of the peripheral edge portions 38*a* of the layer 38 may be formed either by wet etching or by dry etching with high Ar flows. The patterned sacrificial layer 38 should be present directly on silicon or on top of an etch stop material (e.g. silicon nitride) which is selective to the oxide etchant. This layer may also function as an interlevel dielectric in other areas of the chip and thus remain in those areas.

Following next, as per third block 40 and respective schematic representation (c), the heater substrata 22 is processed as desired. First, the heater or resistive layer 24, comprised of a first metal and including the lateral, central and transitional portions 24*a*-24*e*, is deposited over the substrate 20, the sacrificial material layer 38 and its tapered peripheral edge portions 38*a* such that the fluid heater element 16 of the central portion 24*c* of the resistive layer 24 in the heater substrata 22 overlies the sacrificial material layer 38. Next, the conductor layer 26, comprised by a second metal typically selected from a wide variety of conductive metals, a preferred one being Al, is deposited on the first metal resistive layer 24 to complete the deposition of the layers of the first strata 12. The resistive and conductive layers 24, 26 may be coated on the wafer or substrate 20 by conventional sputtering techniques. The Al conductive layer 26 should be the same thickness as the silicon oxide sacrificial layer 38. The resistive and conductor layers 24, 26 may be selected from materials, and the resistive layer 24 may have the thicknesses, such as set forth in above cited U.S. Pat. No. 7,195,343.

Next, as per fourth block 42 and respective schematic representation (d), a photoresist layer 44 is deposited, such as by spin coating, on the wafer or substrate 20 and over the conductive layer 26. As per the fifth through seventh blocks 46-50 and respective schematic representations (e)-(g), the photoresist layer 44 and the conductive layer 26 beneath it are patterned, masked and etched into the form shown in schematic representation (h). In such manner, the one sequence of materials to produce the first strata 12 are processed such that the first resistive metal layer 24 provides the fluid heater element 16 of the heater stack 10 and the second conductor metal layer 26 provides the power (anode portion) lead 26*a* and ground (cathode portion) lead 26*b* for the resistive heater element 16.

More particularly, as per the fifth to seventh blocks 46-50 and as can be seen in schematic representations (e)-(g), the photoresist layer 44 is exposed and developed by conventional means to expose a central portion 26*c* of the conductive layer 26. Then, the conductive layer 26 may be taper-etched using, by way of example, a phosphoric/acetic/nitric acid mixture, as conventionally used in current processes to form Al tapered leads on heater chips. In this taper-etch process, the nitric acid actually "attacks" the photoresist-to-Al tapered interface, lifting the photoresist layer 44 and allowing it to be undercut as the etch progresses, as can be seen in schematic representations (f) and (g). In schematic representation (f), an intermediate state of etching is depicted in which the photoresist 44 has begun to lift about the taper of the Al central portion 26*c* of the conductive layer 26 where it has started to undercut. In schematic representation (g), another intermediate state in the taper-etching is shown in which the photoresist 44 has continued to lift and the central portion 26*c* of the conductive layer 26 is further undercut.

As per the eighth block 52 and schematic representation (h), the taper-etching of the conductive layer 26 is complete and the photoresist 44 is removed, leaving a planar top or upper surface 22*a* on the heater substrata 22 and in particular in the area of the heater element 16. Slight irregularities are shown on the surface of the conductive (Al) layer 26 at 54 in recognition of the fact that it is unreasonable to expect that the top surface will be perfectly planar. Instead, it may be viewed as functionally planar compared to tapers of conventional heater chips that are as high as the thickness of the conductor metal. The definition of Al lines can be accomplished with an additional dry etch, as done conventionally, either before or after this step.

At this point attention should be directed to FIG. 9 wherein there is depicted an alternative process of grayscale lithography followed by dry etching. This alternative process may be used to pattern and mask the central portion 26*c* of the conductive (Al) layer 26. Grayscale lithographs make use of a graded photomask, either in a half-toning or continuous fashion, to expose regions of the photoresist with a gradient of intensities. The resultant resist profile after develop is tapered or sloped, as seen in FIG. 9. Thus, a tapered Al profile can be achieved by dry etching since the resist will gradually be removed by the Al dry etch process, starting at the thinnest portion.

Returning again to FIG. 6B, processing another sequence of materials to produce second strata 14 is performed as per block 56 and schematic representation (i) so as to retain the same level orientation with the first strata 12 and to provide protection of the fluid heater element 16. The heater overcoats making up second strata 14 are deposited over the planar surface 22*a* of the heater substrata 22. These overcoats may be tantalum oxide, aluminum oxide, hafnium oxide, silicon nitride, tantalum, or some combination thereof. It is expected that the thickness can be dramatically reduced relative to current conventional chips due to the improved planarity of the upper surface 22*a* of the heater substrata 22. This reduces previous step coverage requirements and stress concentration locations. The heater stack 10 so produced is depicted in FIGS. 7 and 8 as well as by the schematic representation (i) of FIG. 6B. This is the structure at the stage immediately before removal of the sacrificial layer 38 to produce the heater stack 10 shown in FIGS. 1 and 2.

Finally, upon completion of the processes as per block 56 and schematic representation (i), that is, once the first and second strata 12, 14 of the heater stack 10 are processed as desired, processing the sacrificial material layer 38 of the first strata 12 occurs. The heater substrata 22 are undercut to remove the sacrificial layer 38 using an isotropic oxide etch, e.g. hydrofluoric acid (HF), buffered HF (B-HF), or HF vapor. FIGS. 7 and 8 and (i) of FIG. 6B depict different schematic views of the structure at this stage to show how the undercut is enabled. FIGS. 1 and 2 depict the final structure, showing the gap 28 under the heater substrata 22 and the planar nature of the upper surface 22*a*. Additionally, as shown in FIGS. 3 and 4, it may be desirable to have the protective layer 30 on the underside 22*b* of the heater substrata 22 to protect it from the ink. Removing the sacrificial layer 38 of silicon oxide which extends beyond opposite sides 22*c* of the heater substrata 22 opens the gap 28 along the opposite sides 22*c* of the heater substrata 22, and thus of the heater element 16, and through the second strata 14 to enable communication of flow of fluid between the ejection chamber 18 above the fluid heater element 16 and the gap 28 below the fluid heater element 16 such that the gap 28 will fill with, and heat is transferred to, the same fluid as is ejected from the ejection chamber 18 by the fluid heater element 16. In FIG. 5, an individual via or supply channel 32 beneath the heater substrata 22 is formed first, by performance of a deep reactive ion etch (DRIE) process from the backside 20*b* of the wafer or substrate 20, stopping selectively on the silicon oxide layer 38. Then, second, removal of the silicon oxide layer 38, using an isotropic etch such as HF, B-HF, or HF vapor, to merge the gap 28 with the channel 32.

Referring to FIG. 10, there is illustrated one possible array of the heater stacks 10 shown at a stage equivalent to that depicted by the schematic representation (h) in FIG. 6B. This illustrates the advantage of multiple heater substrata 22 respectively formed on tops of individual ones of multiple oxide islands 58 in that conductive (Al) lines 60 supplying power to the multiple heater substrata 22 can pass between these islands 58. And, in addition to allowing for planarization of the top surfaces 22*a* of the multiple heater substrata 22 and formation of the air gaps 28 under the heater elements 16, the confined nature of the oxide islands 58 allow for a controllable isotropic undercut of the multiple heater substrata 22. If the multiple heater substrata 22 were deposited over the top of a blanket oxide layer, an isotropic undercut would be much more difficult to control since the oxide would rapidly etch in all directions with no inherent etch stop.

To recap, the present invention is thus directed to forming an ultra-low energy (ULE) inkjet heater stack 10 with a planar heater substrata surface 22*a* and a gap 28 beneath it. The planar surface 22*a* allows for minimization of the heater overcoat thickness and the gap greatly reduces heat loss to the substrate 20. Such a heater stack 10 demonstrates greatly improved thermal efficiency over conventional designs due to the dramatic reduction of waste heat into the materials under the heater element 16 and an increase in the bubble nucleation area. Important aspects of the present invention are the following: (1) use of a silicon oxide layer 38 with tapered peripheral edge portions 38*a* over which the heater substrata 22 is coated; (2) use of wet taper etching of the conductive layer 26 or grayscale lithography and dry etching of the conductive layer 26 to achieve co-planar surfaces of the conductive layer 26 and sacrificial layer 38; (3) integration of this approach into a typical inkjet chip process flow; and (4) embodiment shown in FIG. 5 in which the ink via 32 is formed from the backside 20*b* of the substrate 20 and the oxide layer 38 is subsequently removed. Important advantages are: (1) much lower energy used to fire the heater stack 10 thereby reducing thermal dissipation requirements of the chip and enabling faster printing with small drops, enabled by the gap 28 on the backside 22*b* of the heater substrata 22 and the thinner heater overcoats 14, which are, in turn, enabled by the improved planarity of the heater stack 10; (2) ability to be integrated with conventional inkjet chip manufacturing rather than the development of a MEMS-based chip with new processes and materials; (3) achievement of a ULE heater stack without the complexity of integrating a thermally unstable material under the heater element 16; and (4) potential reduction in chip size if the embodiment of FIG. 5 is implemented.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A heater stack for a micro-fluid ejection device, comprising:

first strata configured to support and form a fluid heater element responsive to energy from repetitive electrical activation and deactivation to fire repetitive cycles of heating and ejecting of a fluid from an ejection chamber above said fluid heater element, said first strata including a substrate and a heater substrata overlying said substrate;

said heater substrata including a resistive layer having lateral portions spaced apart from each other, a central portion extending between said lateral portions and defining said fluid heater element of said first strata, and transitional portions respectively interconnecting said central portion and lateral portions and extending upwardly and toward one another from said lateral portions so as to elevate said central portion relative to said lateral portions and spaced above said substrate to form a gap extending between said lateral portions and touching said central portion and said substrate to insulate said substrate from said fluid heater element so as to reduce heat transfer from said fluid heater element to said substrate and thereby increase heat transfer into the fluid in said ejection chamber from firing said repetitive cycles of heating and ejecting of the fluid from the ejection chamber above said fluid heater element; and said heater substrata also including a conductive layer having separate anode and cathode portions on said resistive layer separated from one another by said central portion of said resistive layer and by said gap underlying said fluid heater element of said central portion of said resistive layer, said anode and cathode portions overlying and deposited on said lateral and transitional portions and extending to a height above said lateral portions of said resistive layer that is coplanar with a height of said central portion above said substrate such that said anode and cathode portions are interconnected and separated by said central portion of said resistive layer to define said fluid heater element therewith and also provide said heater substrata with a planar upper surface formed by said anode and cathode portions of said conductive layer and said central portion of said resistive layer.

2. The heater stack of claim 1 further comprising: second strata overlying said anode and cathode portions of said conductor layer and said central portion of said resistive layer defining said fluid heater element of said heater substrata, said second strata including a protective layer contiguous with the ejection chamber and providing protection of said fluid heater element from adverse effects of said repetitive cycles of heating and ejecting fluid from the ejection chamber and of contact with the fluid in the ejection chamber.

3. The heater stack of claim 1 further comprising:

second strata on said heater substrata of said first strata to provide protection of said fluid heater element from adverse effects of said repetitive cycles of heating and ejecting fluid from the ejection chamber and of contact with the fluid in the ejection chamber.

4. The heater stack of claim 2 wherein said protective layer is disposed on said anode and cathode portions of said conductive layer and said central portion of said resistive layer of said first strata in a level orientation overlying said first strata.

5. The heater stack of claim 3 wherein said gap is open along opposite sides of said central portion of said resistive layer of said heater substrata and through portions of said second strata contiguous to said opposite sides to enable communication of flow of fluid between the ejection chamber above said fluid heater element and said gap below said fluid heater element such that said gap is filled with and heat is transferred to the same fluid as is ejected from the ejection chamber by said fluid heater element.

6. The heater stack of claim 5 wherein said heater substrata further includes a protective layer between said substrate and resistive layer so as to overlie said gap and protect an underside of said fluid heater element from prolonged contact with the fluid in said gap, said openings extending through said protective layer along opposite sides of said central portion of said heater substrata.

* * * * *